US010095137B2

(12) United States Patent
Murakami et al.

(10) Patent No.: US 10,095,137 B2
(45) Date of Patent: Oct. 9, 2018

(54) ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Takeshi Murakami, Numazu (JP); Daisuke Kawaguchi, Toride (JP); Kazumichi Sugiyama, Numazu (JP); Daisuke Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/469,949

(22) Filed: Mar. 27, 2017

(65) Prior Publication Data

US 2017/0285500 A1 Oct. 5, 2017

(30) Foreign Application Priority Data

Apr. 4, 2016 (JP) ..... 2016-075479
Jun. 21, 2016 (JP) ..... 2016-122851

(51) Int. Cl.
*G03G 5/14* (2006.01)
*G03G 5/05* (2006.01)

(52) U.S. Cl.
CPC ..... *G03G 5/144* (2013.01); *G03G 5/0525* (2013.01); *G03G 5/142* (2013.01); *G03G 2215/00957* (2013.01)

(58) Field of Classification Search
CPC ..... G03G 5/142; G03G 5/144
See application file for complete search history.

(56) References Cited

U.S. PATENT DOCUMENTS 3,047,384 A * 7/1962 Jones ..... C09B 23/02 430/92
3,798,031 A * 3/1974 Janssens ..... C07D 215/06 252/501.1

(Continued)

FOREIGN PATENT DOCUMENTS

JP 02176665 A * 7/1990
JP 2001-033999 2/2001

(Continued)

OTHER PUBLICATIONS

English language machine translation of JP 02-176665 (Jul. 1990).*

(Continued)

*Primary Examiner* — Christopher D Rodee
(74) *Attorney, Agent, or Firm* — Fitzpatrick Cella Harper and Scinto

(57) ABSTRACT

Provided is an electrophotographic photosensitive member that can suppress a ghost image while keeping its sensitivity satisfactory. The electrophotographic photosensitive member includes a support, an intermediate layer on the support, and a photosensitive layer on the intermediate layer, and the intermediate layer contains a compound having a specific structure.

14 Claims, 1 Drawing Sheet

(56) References Cited

U.S. PATENT DOCUMENTS

| | | | | |
|---|---|---|---|---|
| 3,830,647 | A * | 8/1974 | Janssens | C07D 215/06 430/63 |
| 4,908,329 | A | 3/1990 | Kanai et al. | |
| 4,908,330 | A | 3/1990 | Arai et al. | |
| 5,356,744 | A * | 10/1994 | Yanus | G03G 5/06 430/62 |
| 5,759,291 | A | 6/1998 | Ichinose et al. | |
| 6,562,530 | B2 | 5/2003 | Morikawa et al. | |
| 6,806,009 | B2 | 10/2004 | Tanaka et al. | |
| 6,815,135 | B2 | 11/2004 | Morikawa et al. | |
| 6,835,512 | B2 | 12/2004 | Morikawa et al. | |
| 6,913,862 | B2 | 7/2005 | Nakata et al. | |
| 6,998,210 | B2 | 2/2006 | Yoshimura et al. | |
| 7,022,446 | B2 | 4/2006 | Yoshimura et al. | |
| 7,078,140 | B2 | 7/2006 | Yoshimura et al. | |
| 7,989,129 | B2 * | 8/2011 | Wu | G03G 5/0614 430/58.5 |
| 8,512,922 | B2 | 8/2013 | Ishiduka et al. | |
| 8,632,935 | B2 | 1/2014 | Sugiyama et al. | |
| 8,765,335 | B2 | 7/2014 | Tanaka et al. | |
| 8,841,052 | B2 | 9/2014 | Watariguchi et al. | |
| 8,974,991 | B2 | 3/2015 | Kawahara et al. | |
| 9,068,083 | B2 | 6/2015 | Tanaka et al. | |
| 9,158,213 | B2 | 10/2015 | Taniguchi et al. | |
| 9,164,406 | B2 | 10/2015 | Nishi et al. | |
| 9,170,506 | B2 | 10/2015 | Tanaka et al. | |
| 9,170,507 | B2 | 10/2015 | Sugiyama et al. | |
| 9,274,496 | B2 | 3/2016 | Miyagawa et al. | |
| 9,280,071 | B2 | 3/2016 | Maruyama et al. | |
| 9,304,414 | B2 | 4/2016 | Miura et al. | |
| 9,405,206 | B2 | 8/2016 | Kawaguchi et al. | |
| 9,411,307 | B2 | 8/2016 | Matsuda et al. | |
| 9,436,107 | B2 | 9/2016 | Murakami et al. | |
| 9,459,542 | B2 | 10/2016 | Tanaka et al. | |
| 9,535,347 | B2 | 1/2017 | Watariguchi et al. | |
| 2007/0048639 | A1 * | 3/2007 | Wu | G03G 5/047 430/60 |
| 2008/0311497 | A1 * | 12/2008 | Wu | G03G 5/0609 430/59.5 |
| 2009/0246662 | A1 * | 10/2009 | Wu | G03G 5/0614 430/58.8 |
| 2014/0212800 | A1 | 7/2014 | Miura et al. | |
| 2016/0026098 | A1 | 1/2016 | Murakami et al. | |
| 2016/0378002 | A1 | 12/2016 | Tanaka et al. | |

FOREIGN PATENT DOCUMENTS

| | | |
|---|---|---|
| JP | 2006-221094 | 8/2006 |
| JP | 2011-128596 | 6/2011 |

OTHER PUBLICATIONS

Diamond, Arthur S (editor) Handbook of Imaging Materials. New York: Marcel-Dekker, Inc. (2002) pp. 145-164.*

* cited by examiner

ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC IMAGE FORMING APPARATUS

BACKGROUND OF THE INVENTION

Field of the Invention

The present invention relates to an electrophotographic photosensitive member, a method of producing an electrophotographic photosensitive member, a process cartridge, and an electrophotographic image forming apparatus.

Description of the Related Art

An electrophotographic photosensitive member including a support, an intermediate layer on the support, and a photosensitive layer on the intermediate layer, in which the photosensitive layer contains an organic charge generating material and an organic charge transporting material, has been used as an electrophotographic photosensitive member to be used in an electrophotographic image forming apparatus. The intermediate layer has a function of blocking charge, and serves to suppress the injection of charge from the support toward the photosensitive layer to suppress the occurrence of an image defect, such as a black dot.

In recent years, a charge generating material having higher sensitivity has been used in association with demands for improvements in resolution and definition of the electrophotographic image forming apparatus. However, the quantity of charge remaining in the photosensitive layer increases in association with an increase in charge generation quantity due to a rise in sensitivity of the charge generating material. As a result, there arises a problem in that a ghost is liable to occur. Specifically, a so-called positive ghost phenomenon in which the density of only a portion irradiated with light at the time of a previous rotation (at the time of the formation of a previous image) increases in an output image, or a so-called negative ghost phenomenon in which the density of only a portion irradiated with light at the time of a previous rotation reduces in an output image is liable to occur.

In addition to the forgoing, further improvements in speed and image quality of the electrophotographic image forming apparatus have been required in association with colorization of laser beam printers in recent years, and hence the electrophotographic photosensitive member is required to have more excellent characteristics. One of the required characteristics is to suppress the deterioration of an image due to a ghost phenomenon.

A technology involving adding a charge transporting material to the intermediate layer is available as a technology for the suppression of such remaining of charge. In Japanese Patent Application Laid-Open No. 2006-221094, there is a disclosure of a technology involving incorporating a metal oxide and a compound having an anthraquinone structure into an intermediate layer to suppress a ghost. In addition, in Japanese Patent Application Laid-Open No. 2001-33999, there is a disclosure of a technology involving incorporating a compound having a quinolinol structure into a charge generating layer to improve the flow of charge. Further, in Japanese Patent Application Laid-Open No. 2011-128596, there is a disclosure of a technology involving incorporating a metal oxide and a compound having a fluorenone structure into an intermediate layer to suppress a fluctuation in potential over a long time period.

SUMMARY OF THE INVENTION

However, it cannot be said that the remaining of charge is sufficiently solved by the technology disclosed in Japanese Patent Application Laid-Open No. 2006-221094, Japanese Patent Application Laid-Open No. 2001-33999, or Japanese Patent Application Laid-Open No. 2011-128596. Accordingly, there is room for further improvement with regard to the deterioration of an image due to a ghost phenomenon.

The present invention has been made in view of the above-mentioned circumstances.

One aspect of the present invention is directed to providing an electrophotographic photosensitive member and a method of producing the same, in which the deterioration of an image due to a ghost phenomenon of the electrophotographic photosensitive member can be suppressed, while the sensitivity of the electrophotographic photosensitive member is kept satisfactory.

In addition, another aspect of the present invention is directed to providing a process cartridge and an electrophotographic image forming apparatus which contribute to the formation of high-quality electrophotographic images.

According to one aspect of the present invention, there is provided an electrophotographic photosensitive member, including:

a support;

an intermediate layer on the support; and a photosensitive layer on the intermediate layer, in which the intermediate layer contains a metal oxide and at least one selected from the group consisting of a compound represented by the general formula (1), a compound represented by the general formula (2), and a compound represented by the general formula (3):

General formula (1)

(1)

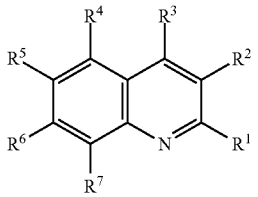

General formula (2)

(2)

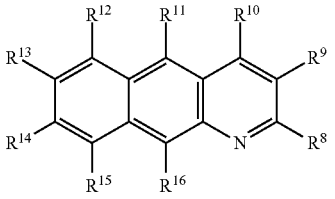

in the general formulae (1) and (2), $R^1$ to $R^{16}$ each independently represent a hydrogen atom, an alkyl group, a hydroxy group, a carboxy group, an amino group, an alkoxy group, or a substituted or unsubstituted aryl group, and a substituent of the substituted aryl group is an alkyl group, an aryl group, a halogen atom, a hydroxy group, or a carboxy group;

General formula (3)

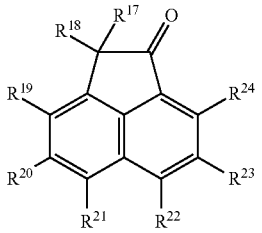

(3)

in the general formula (3), $R^{17}$ to $R^{24}$ each independently represent a hydrogen atom, a substituted or unsubstituted alkyl group, a hydroxy group, a carboxy group, an amino group, an alkoxy group, a group obtained by substituting one carbon atom in a main chain of the alkyl group with an oxygen atom, or a group obtained by substituting one carbon atom in the main chain of the alkyl group with a nitrogen atom, and a substituent of the substituted alkyl group is an alkyl group, an aryl group, a halogen atom, or a carbonyl group.

According to another aspect of the present invention, there is provided a method of producing an electrophotographic photosensitive member including a support, an intermediate layer formed on the support, and a photosensitive layer formed on the intermediate layer, the production method including:

forming, on the support, a coat of a coating liquid for an intermediate layer containing a metal oxide and at least one selected from the group consisting of a compound represented by the general formula (1), a compound represented by the general formula (2), and a compound represented by the general formula (3); and drying the coat to form the intermediate layer:

General formula (1)

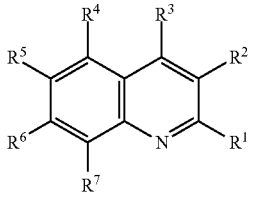

(1)

General formula (2)

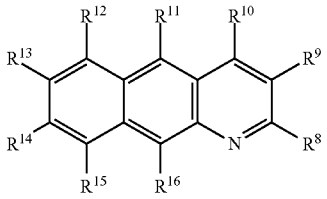

(2)

in the general formulae (1) and (2), $R^{1}$ to $R^{16}$ each independently represent a hydrogen atom, an alkyl group, a hydroxy group, a carboxy group, an amino group, an alkoxy group, or a substituted or unsubstituted aryl group, and a substituent of the substituted aryl group is an alkyl group, an aryl group, a halogen atom, a hydroxy group, or a carboxy group;

General formula (3)

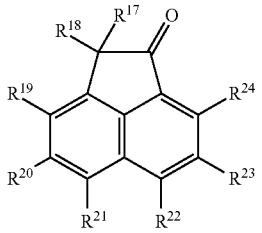

(3)

in the general formula (3), $R^{17}$ to $R^{24}$ each independently represent a hydrogen atom, a substituted or unsubstituted alkyl group, a hydroxy group, a carboxy group, an amino group, an alkoxy group, a group obtained by substituting one carbon atom in a main chain of the alkyl group with an oxygen atom, or a group obtained by substituting one carbon atom in the main chain of the alkyl group with a nitrogen atom, and a substituent of the substituted alkyl group is an alkyl group, an aryl group, a halogen atom, or a carbonyl group.

According to still another aspect of the present invention, there is provided a process cartridge, including: the electrophotographic photosensitive member; and at least one device selected from the group consisting of a charging device, a developing device, and a cleaning device, the process cartridge integrally supporting the electrophotographic photosensitive member and the at least one device, and being removably mounted onto a main body of an electrophotographic image forming apparatus.

According to yet still another aspect of the present invention, there is provided an electrophotographic image forming apparatus, including: the electrophotographic photosensitive member; a charging device; an exposing device; a developing device; and a transferring device.

Further features of the present invention will become apparent from the following description of exemplary embodiments with reference to the attached drawings.

DESCRIPTION OF THE EMBODIMENTS

Figure 1:
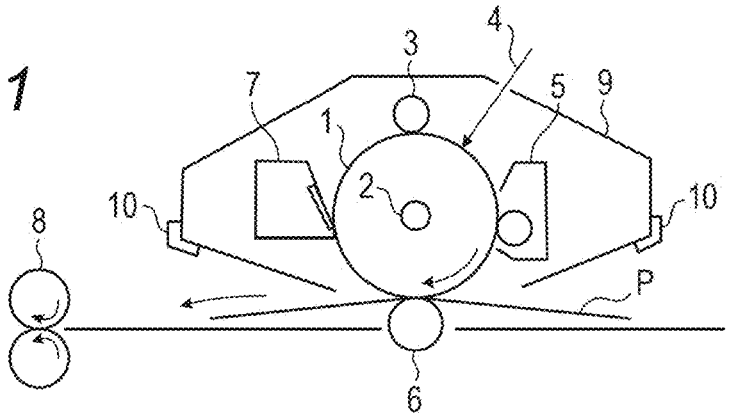
FIG. 1 is a view for illustrating an example of the schematic construction of an electrophotographic image forming apparatus including a process cartridge including an electrophotographic photosensitive member according to one aspect of the present invention.

Preferred embodiments of the present invention will now be described in detail in accordance with the accompanying drawings.

An electrophotographic photosensitive member according to one aspect of the present invention includes: a support; an intermediate layer on the support; and a photosensitive layer on the intermediate layer, in which the intermediate layer contains a metal oxide and at least one selected from the group consisting of a compound represented by the general formula (1), a compound represented by the general formula (2), and a compound represented by the general formula (3):

General formula (1)

(1)

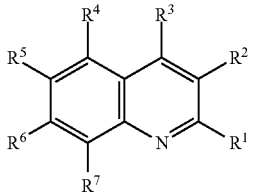

General formula (2)

(2)

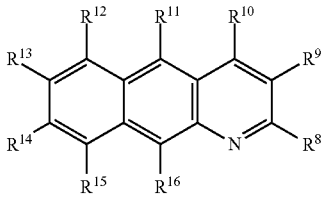

in the general formulae (1) and (2), $R^1$ to $R^{16}$ each independently represent a hydrogen atom, an alkyl group, a hydroxy group, a carboxy group, an amino group, an alkoxy group, or a substituted or unsubstituted aryl group, and a substituent of the substituted aryl group is an alkyl group, an aryl group, a halogen atom, a hydroxy group, or a carboxy group;

General formula (3)

(3)

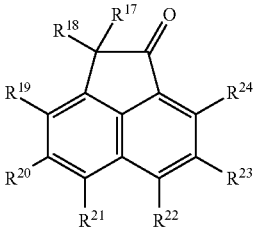

in the general formula (3), $R^{17}$ to $R^{24}$ each independently represent a hydrogen atom, a substituted or unsubstituted alkyl group, a hydroxy group, a carboxy group, an amino group, an alkoxy group, a group obtained by substituting one carbon atom in a main chain of the alkyl group with an oxygen atom, or a group obtained by substituting one carbon atom in the main chain of the alkyl group with a nitrogen atom, and a substituent of the substituted alkyl group is an alkyl group, an aryl group, a halogen atom, or a carbonyl group.

The inventors of the present invention have assumed the reason why the incorporation of at least one selected from the group consisting of the compounds represented by the general formulae (1) to (3) into the intermediate layer is excellent in suppression of a ghost phenomenon to be as described below.

The compound represented by the general formula (1) or (2) has high polarity because the compound has a nitrogen atom at a position shifting from its axis of symmetry. In addition, the compound is of a structure whose conjugated system is structurally wide. By virtue of the foregoing, when the compound accepts an electron from the photosensitive layer, the remaining of the electron in the compound hardly occurs. As a result, the flow of the electron from the photosensitive layer to the intermediate layer is smoothened, and hence the remaining of charge in the photosensitive layer responsible for a ghost can be suppressed.

In addition, the compound represented by the general formula (3) has an acenaphthenone structure. The acenaphthenone structure is a structure having a high dipole moment derived from a five-membered ring structure and a =O group bonded to the five-membered ring. A compound having a structure having a high dipole moment is known to have the following property: charge hardly remains in the compound. Therefore, the use of the compound represented by the general formula (3) in the intermediate layer smoothens the flow of an electron from the photosensitive layer to the intermediate layer, and hence can suppress the remaining of charge in the photosensitive layer responsible for a ghost.

In addition, when at least one of the compounds represented by the general formulae (1) to (3) is provided with a structure that forms a complex with the metal oxide (whose details are described later) in the intermediate layer, and hence the rigidity of a complex forming portion is improved, energy at the time of the oxidation of the compound reduces. Accordingly, the remaining of charge in the compound can be suppressed. In addition, when at least one of the compounds represented by the general formulae (1) to (3) forms the complex with the metal oxide, a distance between the compound and the metal oxide shortens. Accordingly, the exchange of an electron from the photosensitive layer, or the exchange of an electron between molecules of the metal oxide is smoothened. As a result, the remaining of charge in the photosensitive layer responsible for a ghost can be suppressed. Therefore, a ghost suppressing effect is further improved by using, in the intermediate layer, the metal oxide in combination with at least one of the compounds represented by the general formulae (1) to (3).

It is preferred that at least one of $R^1$ to $R^7$ in the general formula (1), at least one of $R^8$ to $R^{16}$ in the general formula (2), or at least one of $R^{17}$ to $R^{24}$ in the general formula (3) represent a hydroxy group or a carboxy group in terms of a dipole moment.

In addition, it is more preferred that at least one selected from $R^7$, $R^{15}$, $R^{17}$, $R^{18}$, and $R^{24}$ represent a hydroxy group or a carboxy group in terms of the formation of the complex with the metal oxide.

In addition, it is preferred that $R^1$ to $R^7$ in the general formula (1), $R^8$ to $R^{16}$ in the general formula (2), or $R^{17}$ to $R^{24}$ in the general formula (3) each independently represent a hydrogen atom, a hydroxy group, or a carboxy group.

Specific exemplified compounds of the compounds represented by the general formulae (1) to (3) are shown in Table 1 to Table 3 below. However, the present invention is not limited thereto.

TABLE 1

| | $R^1$ | $R^2$ | $R^3$ | $R^4$ | $R^5$ | $R^6$ | $R^7$ |
|---|---|---|---|---|---|---|---|
| Compound 1 | H | H | H | H | H | H | OH |
| Compound 2 | H | H | H | H | H | H | COOH |
| Compound 3 | H | H | H | H | H | H | $CH_3$ |
| Compound 4 | H | H | H | H | H | H | $NH_2$ |
| Compound 5 | H | H | H | $NH_2$ | H | OH | H |
| Compound 6 | H | H | H | H | H | OH | OH |
| Compound 7 | H | H | H | H | H | H | O—$C_6H_5$ |

TABLE 2

| | $R^8$ | $R^9$ | $R^{10}$ | $R^{11}$ | $R^{12}$ | $R^{13}$ | $R^{14}$ | $R^{15}$ | $R^{16}$ |
|---|---|---|---|---|---|---|---|---|---|
| Compound 11 | H | H | H | H | H | H | H | OH | H |
| Compound 12 | H | H | H | H | H | H | H | COOH | H |
| Compound 13 | H | H | H | H | H | H | H | $CH_3$ | H |
| Compound 14 | H | H | H | H | H | H | H | $NH_2$ | H |
| Compound 15 | H | H | H | H | $NH_2$ | H | OH | H | H |
| Compound 16 | H | H | H | H | H | H | OH | OH | H |
| Compound 17 | H | H | H | H | H | H | H | O—$C_6H_5$ | H |

TABLE 3

| | $R^{17}$ | $R^{18}$ | $R^{19}$ | $R^{20}$ | $R^{21}$ | $R^{22}$ | $R^{23}$ | $R^{24}$ |
|---|---|---|---|---|---|---|---|---|
| Compound 18 | H | H | H | H | H | H | H | H |
| Compound 19 | H | H | H | H | H | H | H | OH |
| Compound 20 | H | H | H | H | H | H | H | COOH |
| Compound 21 | OH | H | H | H | H | H | H | H |
| Compound 22 | COOH | H | H | H | H | H | H | H |
| Compound 23 | H | H | H | OH | H | H | H | H |
| Compound 24 | H | H | H | COOH | H | H | H | H |
| Compound 25 | H | H | H | $NH_2$ | H | H | H | H |
| Compound 26 | H | H | H | O—$C_6H_5$ | H | H | H | H |
| Compound 27 | H | H | H | H | H | H | OH | OH |
| Compound 28 | H | H | H | $NH_2$ | H | H | H | OH |
| Compound 29 | H | H | OH | H | OH | H | H | H |
| Compound 30 | OH | H | H | H | H | H | OH | H |

The content of the compounds represented by the general formulae (1) to (3) is preferably 0.1 mass % or more and 50 mass % or less, more preferably 0.1 mass % or more and 30 mass % or less with respect to the total mass of the intermediate layer.

In addition, the content of the compounds represented by the general formulae (1) to (3) in the intermediate layer is preferably 0.05 mass % or more and 20 mass % or less, more preferably 0.05 mass % or more and 5 mass % or less with respect to the metal oxide in the intermediate layer. When the content is 0.05 mass % or more, the compounds represented by the general formulae (1) to (3) and the metal oxide sufficiently interact with each other, and hence an excellent ghost suppressing effect is obtained.

The intermediate layer contains the metal oxide. An arbitrary shape, such as a needle shape, a star shape, or a flake shape, can be selected as the shape of the metal oxide to be incorporated into the intermediate layer from the viewpoint of, for example, the prevention of interference fringes, adhesiveness with an upper layer, or the strength of a coat. Of those, a shape having such a large specific surface area as to be capable of sufficiently act on the compounds represented by the general formulae (1) to (3) is preferred, and a particulate shape (a metal oxide particle) is particularly preferred. The metal oxide is preferably of a kind containing titanium oxide, zinc oxide, tin oxide, zirconium oxide, or aluminum oxide in terms of conductivity, and a particle containing these metal oxides is more preferred. A particle containing titanium oxide, zinc oxide, or tin oxide are particularly preferred. In addition, the metal oxide particle may be a metal oxide particle whose surfaces is treated with a surface treatment agent, such as a silane coupling agent.

The average primary particle diameter of the metal oxide particles is preferably 30 nm or more and 500 nm or less, more preferably 50 nm or more and 300 nm or less. The average primary particle diameter of the metal oxide particles is obtained by: observing a section of the intermediate layer with a scanning electron microscope (SEM) or the like; measuring the particle diameters of 100 arbitrary particles; and determining the average of the measured values.

The intermediate layer may contain a binder resin. Examples of the binder resin include an acrylic resin, an allyl resin, an alkyd resin, an ethylcellulose resin, an ethylene-acrylic acid copolymer, an epoxy resin, a casein resin, a silicone resin, a gelatin resin, a phenol resin, a butyral resin, polyacrylate, polyacetal, polyamide imide, polyamide, polyallyl ether, polyimide, polyurethane, polyester, polyethylene, polycarbonate, polystyrene, polysulfone, polyvinyl alcohol, polybutadiene, and polypropylene. Of those, polyurethane is preferred.

The content of the binder resin in the intermediate layer is preferably 10 mass % or more and 50 mass % or less with respect to the metal oxide. When the content is 10 mass % or more and 50 mass % or less, the uniformity of the coat of the intermediate layer becomes more satisfactory.

Figure 2:
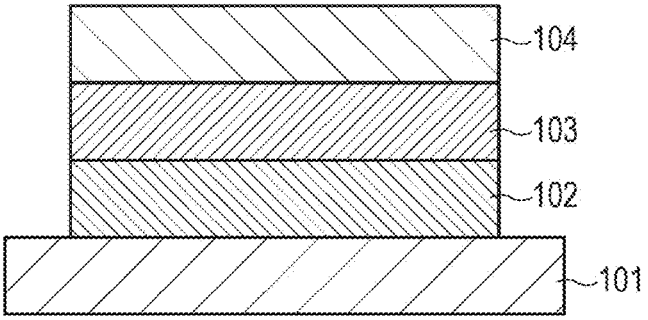
FIG. 2 is a view for illustrating an example of the layer construction of the electrophotographic photosensitive member according to one aspect of the present invention.

As illustrated in, for example, FIG. 2, the electrophotographic photosensitive member according to one aspect of the present invention includes a support 101, an intermediate layer 102 on the support 101, and a photosensitive layer on the intermediate layer 102. In the example illustrated in FIG. 2, the photosensitive layer is formed of a charge generating layer 103 and a charge transporting layer 104 laminated thereon.

Examples of the photosensitive layer include: a single-layer photosensitive layer containing a charge generating material and a charge transporting material in a single layer; and a laminated (function-separated) photosensitive layer separated into a charge generating layer containing the charge generating material and a charge transporting layer containing the charge transporting material. Of those, a laminated photosensitive layer having the charge generating layer and the charge transporting layer on the charge generating layer is preferred. In addition, a protective layer may be further formed on the photosensitive layer.

[Support]

The support is preferably a support having conductivity (conductive support). Examples of the conductive support include metals or alloys, such as aluminum, stainless steel, copper, iron, nickel, gold, and zinc. In the case of a support made of aluminum or an aluminum alloy, an extrusion drawing (ED) tube or an extrusion ironing (EI) tube, or a product obtained by subjecting any such tube to cutting, electrolytic composite polishing (electrolysis with an electrode having an electrolytic action and an electrolytic solution, and polishing with a grindstone having a polishing action), or a wet or dry honing treatment can be used. In addition, the examples also include: a metal support; and a support obtained by forming a conductive thin film on a resin support, such as a polyester resin, a polycarbonate resin, or a polyimide resin, or on an insulating support, such as glass. Examples of the conductive thin film include: a metal thin film, such as aluminum, an aluminum alloy, chromium, silver, or gold; a thin film of a conductive material, such as indium oxide, tin oxide, zinc oxide, or an indium oxide-tin oxide alloy; and a thin film of a conductive ink having added thereto a silver nanowire.

Examples of the shape of the support include a cylindrical shape, a belt shape, and a film shape. Of those, a cylindrical shape is preferred.

The surface of the support may be subjected to an electrochemical treatment, such as anodic oxidation, a wet honing treatment, a blast treatment, a cutting treatment, a surface roughening treatment, or an alumite treatment for the purpose of improving its electrical characteristics, or suppressing interference fringes due to the scattering of laser light.

[Conductive Layer]

A conductive layer may be arranged between the support and the intermediate layer to be described later for the purpose of, for example, suppressing interference fringes due to the scattering of laser light or covering a flaw in the support. The conductive layer preferably contains a conductive particle and a binder resin.

The conductive layer can be formed by: applying a coating liquid for a conductive layer onto the support to form a coat; and heat-drying (thermally curing) the coat. The coating liquid for a conductive layer can be obtained by, for example, dispersing the conductive particle together with the binder resin and a solvent.

Examples of the binder resin to be used in the conductive layer include polyester, polycarbonate, polyvinyl butyral, an acrylic resin, a silicone resin, an epoxy resin, a melamine resin, a urethane resin, a phenol resin, and an alkyd resin.

Examples of the conductive particle include zinc oxide, white lead, aluminum oxide, indium oxide, silicon oxide, zirconium oxide, tin oxide, titanium oxide, magnesium oxide, antimony oxide, bismuth oxide, indium oxide doped with tin, a particle of tin oxide or zirconium oxide doped with antimony or tantalum, and carbon black. Of those, a particle of zinc oxide, titanium oxide, or tin oxide are preferred. In addition, the surfaces of the conductive particle may be treated with a silane coupling agent or the like in order that the dispersibility of the conductive particle may be improved. Further, the conductive particle may each be doped with another metal or metal oxide in order that the resistance of the conductive layer may be controlled.

Examples of the solvent of the coating liquid for a conductive layer include an ether-based solvent, an ester-based solvent, an alcohol-based solvent, a ketone-based solvent, a sulfoxide-based solvent, and an aromatic hydrocarbon-based solvent.

A dispersion method for dispersing the conductive particle in the solvent is, for example, a method involving using a paint shaker, a sand mill, a ball mill, or a liquid collision-type high-speed disperser.

The thickness of the conductive layer is preferably 5 μm or more and 40 μm or less. In particular, the thickness is more preferably 10 μm or more and 30 μm or less.

[Intermediate Layer]

The intermediate layer described above is arranged between the support or the conductive layer and the photosensitive layer to be described later.

The intermediate layer can be formed by: applying a coating liquid for an intermediate layer onto the support or the conductive layer to form a coat; and drying the coat.

Specifically, first, the coating liquid for an intermediate layer containing constituent components for the intermediate layer, such as at least one selected from the group consisting of the compounds represented by the general formulae (1) to (3) and the metal oxide, and as required, the binder resin, is prepared (preparing step). The coating liquid for an intermediate layer may be a coating liquid for an intermediate layer prepared by: dissolving at least one of the compounds represented by the general formulae (1) to (3) in a solvent; and adding a liquid having dissolved therein the binder resin and the metal oxide to the solution. In addition, the coating liquid for an intermediate layer may be a coating liquid for an intermediate layer obtained by: adding the liquid having dissolved therein the binder resin to a dispersion liquid obtained by subjecting the metal oxide and at least one of the compounds represented by the general formulae (1) to (3) to a dispersion treatment together with the solvent; and further subjecting the mixture to a dispersion treatment. A method for the dispersion is, for example, a method involving using a homogenizer, an ultrasonic disperser, a ball mill, a sand mill, a roll mill, a vibration mill, an attritor, or a liquid collision-type high-speed disperser.

A method of forming the intermediate layer first involves forming the coat of the coating liquid for an intermediate layer prepared by the above-mentioned method (applying step). The intermediate layer can be formed by drying the coat (drying step). Therefore, a method of producing the electrophotographic photosensitive member according to one aspect of the present invention includes, as the method of forming the intermediate layer, the step of forming, on the support, the coat of the coating liquid for an intermediate layer containing the metal oxide and at least one selected from the group consisting of the compounds represented by the general formulae (1) to (3), and the step of drying the coat to form the intermediate layer. In the drying step, the coat is more preferably dried while being heated.

Examples of the solvent to be used in the coating liquid for an intermediate layer include organic solvents, such as an alcohol-based solvent, a sulfoxide-based solvent, a ketone-based solvent, an ether-based solvent, an ester-based solvent, an aliphatic halogenated hydrocarbon-based solvent, and an aromatic compound.

In addition to the foregoing, for example, an organic resin fine particle, a leveling agent, or the like may be incorporated into the intermediate layer. A hydrophobic organic resin particle, such as a silicone particle, or a hydrophilic organic resin particle, such as a crosslinked polymethyl methacrylate resin (PMMA) particle, can be used as the organic resin fine particle.

The thickness of the intermediate layer is preferably 0.5 μm or more and 40 μm or less. In particular, the thickness is more preferably 1 μm or more and 30 μm or less.

[Photosensitive Layer]

The photosensitive layer (the charge generating layer and the charge transporting layer) is formed on the intermediate layer. The photosensitive layers of electrophotographic photosensitive members are roughly classified mainly into (1) a laminated photosensitive layer and (2) a single-layer photosensitive layer. (1) The laminated photosensitive layer has a charge generating layer containing a charge generating material and a charge transporting layer containing a charge transporting material. (2) The single-layer photosensitive layer is a single photosensitive layer containing both the charge generating material and the charge transporting material.

(1) Laminated Photosensitive Layer

The laminated photosensitive layer has the charge generating layer containing the charge generating material and the charge transporting layer containing the charge transporting material. A forward-laminated photosensitive layer in which the charge generating layer and the charge transporting layer are laminated in the stated order from a support side is preferred. The forward-laminated photosensitive layer is described below.

(1-1) Charge Generating Layer

The charge generating layer contains the charge generating material, and preferably further contains a binder resin.

The charge generating layer can be formed by: applying a coating liquid for a charge generating layer to form a coat; and drying the resultant coat. The coating liquid for a charge generating layer can be obtained by, for example, subjecting the charge generating material to a dispersion treatment together with the binder resin and a solvent.

In addition, the charge generating layer may be a deposited film of the charge generating material.

Examples of the charge generating material include an azo pigment, a phthalocyanine pigment, an indigo pigment, a perylene pigment, a polycyclic quinone pigment, a squarylium dye, a thiopyrylium salt, a triphenylmethane dye, a quinacridone pigment, an azulenium salt pigment, a cyanine colorant, an anthanthrone pigment, a pyranthrone pigment, a xanthene dye, a quinoneimine dye, a styryl dye, an anthraquinone derivative, a dibenzpyrenequinone derivative, a pyranthrone derivative, a violanthrone derivative, an isoviolanthrone derivative, an indigo derivative, a thioindigo derivative, and a bisbenzimidazole derivative. Those charge generating materials may be used alone or in combination thereof. Of those charge generating materials, a phthalocyanine pigment or an azo pigment is preferred from the viewpoint of sensitivity. In particular, a phthalocyanine pigment is more preferred.

Of the phthalocyanine pigments, in particular, an oxytitanium phthalocyanine, a chlorogallium phthalocyanine, or a hydroxygallium phthalocyanine shows excellent charge generation efficiency. Further, of the hydroxygallium phthalocyanines, a hydroxygallium phthalocyanine crystal of a crystal form having strong peaks at Bragg angles 2θ in CuKα characteristic X-ray diffraction of 7.4°±0.3° and 28.2°±0.3° is more preferred from the viewpoint of sensitivity.

Examples of the binder resin to be used in the charge generating layer include a polymer or a copolymer of a vinyl compound, such as styrene, vinyl acetate, vinyl chloride, an acrylate, a methacrylate, vinylidene fluoride, or trifluoroethylene, an acrylic resin, an allyl resin, an alkyd resin, an epoxy resin, a diallyl phthalate resin, a styrene-butadiene copolymer, a butyral resin, a benzal resin, polyacrylate, polyacetal, polyamide imide, polyamide, polyallyl ether, polyarylate, polyimide, polyurethane, polyester, polyethylene, polycarbonate, polystyrene, polysulfone, polyphenylene oxide, polyvinyl acetal, polybutadiene, polypropylene, a methacrylic resin, a urea resin, a cellulose resin, a phenol resin, a melamine resin, a silicon resin, an epoxy resin, a vinyl chloride-vinyl acetate copolymer, a vinyl acetate resin, and a vinyl chloride resin. Of those, polyester, polycarbonate, and polyvinyl acetal are preferred, and a butyral resin is particularly preferred. Those resins may be used alone or as a mixture or a copolymer thereof.

With regard to a ratio between the charge generating material and the binder resin, the amount of the charge generating material is more preferably 0.3 part by mass or more and 10 parts by mass or less with respect to 1 part by mass of the binder resin.

Examples of the solvent to be used in the coating liquid for a charge generating layer include an alcohol-based solvent, a sulfoxide-based solvent, a ketone-based solvent, an ether-based solvent, an ester-based solvent, an aliphatic halogenated hydrocarbon-based solvent, and an aromatic hydrocarbon-based solvent. The thickness of the charge generating layer is preferably 0.01 μm or more and 5 μm or less, more preferably 0.1 μm or more and 2 μm or less. In addition, various sensitizers, antioxidants, UV absorbers, and plasticizers can each be added to the charge generating layer as required.

(1-2) Charge Transporting Layer

The charge transporting layer contains the charge transporting material, and preferably further contains a binder resin.

The charge transporting layer can be formed by: applying a coating liquid for a charge transporting layer to form a coat; and drying the resultant coat. The coating liquid for a charge transporting layer can be obtained by, for example, dissolving the charge transporting material and the binder resin in a solvent.

Examples of the charge transporting material include a polycyclic aromatic compound, a heterocyclic compound, a triarylamine compound, a hydrazone compound, a styryl compound, a stilbene compound, a butadiene compound, an enamine compound, and a benzidine compound. In addition, examples of the charge transporting material may also include polymers each having, in a main chain or a side chain thereof, a group introduced from those compounds. Those charge transporting material s may be used alone or in combination thereof. Of those, a triarylamine compound or a benzidine compound is preferred from the viewpoints of potential stability at the time of repeated use and the mobility of charge.

Examples of the binder resin to be used in the charge transporting layer include an acrylic resin, an acrylonitrile resin, an allyl resin, an alkyd resin, an epoxy resin, a silicone resin, a phenol resin, a phenoxy resin, polyacrylamide, polyamide imide, polyamide, polyallyl ether, polyarylate, polyimide, polyurethane, polyester, polyethylene, polycarbonate, polysulfone, polyphenylene oxide, polybutadiene, polypropylene, a methacrylic resin, polystyrene, polyvinyl acetate, vinylidene chloride, and an acrylonitrile copolymer. Of those, polyarylate or polycarbonate is preferred. Those binder resins may be used alone or as a mixture or a copolymer thereof.

With regard to a ratio between the charge transporting material and the binder resin in the charge transporting layer, the amount of the charge transporting material is preferably 0.3 part by mass or more and 10 parts by mass or less with respect to 1 part by mass of the binder resin. In addition, a drying temperature is preferably 60° C. or more and 150° C. or less, more preferably 80° C. or more and 120° C. or less from the viewpoint of suppressing a crack in the charge transporting layer. In addition, a drying time is preferably 10 minutes or more and 60 minutes or less.

Examples of the solvent to be used in the coating liquid for a charge transporting layer include an alcohol-based solvent, a sulfoxide-based solvent, a ketone-based solvent, an ether-based solvent, an ester-based solvent, an aliphatic halogenated hydrocarbon-based solvent, and an aromatic hydrocarbon-based solvent.

When the electrophotographic photosensitive member has one charge transporting layer, the thickness of the charge transporting layer is preferably 5 μm or more and 40 μm or less, more preferably 8 μm or more and 30 μm or less. The charge transporting layer may be of a construction formed of a plurality of layers, and when the charge transporting layer is of a laminated construction having two layers, the thickness of a charge transporting layer on the support side is preferably 5 μm or more and 30 μm or less, and the thickness of a charge transporting layer on a surface side is preferably 1 μm or more and 10 μm or less.

In addition, an antioxidant, a UV absorber, a plasticizer, or the like can be added to the charge transporting layer as required.

(2) Single-Layer Photosensitive Layer

The single-layer photosensitive layer contains the charge generating material and the charge transporting material.

The single-layer photosensitive layer can be formed by: forming a coat of a coating liquid for a photosensitive layer; and drying the coat. The coating liquid for a photosensitive layer can be prepared by mixing the charge generating material, the charge transporting material, and a binder resin in a solvent. Examples of the charge generating material, the charge transporting material, and the binder resin are the same as those of the materials in the section "(1) Laminated Photosensitive Layer."

[Protective Layer]

In addition, a protective layer (second charge transporting layer) may be arranged on the photosensitive layer (charge transporting layer) for the purpose of, for example, protecting the photosensitive layer to improve its abrasion resistance or cleaning property.

The protective layer can be formed by: applying a coating liquid for a protective layer obtained by dissolving a binder resin in an organic solvent to form a coat; and drying the resultant coat. Examples of the resin to be used in the protective layer include polyvinyl butyral, polyester, polycarbonate, polyamide, polyimide, polyarylate, polyurethane, a styrene-butadiene copolymer, a styrene-acrylic acid copolymer, and a styrene-acrylonitrile copolymer.

In addition, in order that a charge transporting ability may be imparted to the protective layer, the protective layer may be formed by curing a monomer material having a charge transporting ability or a polymer-type charge transporting material through the use of various crosslinking reactions. The protective layer is preferably formed by polymerizing or crosslinking a charge transportable compound having a chain-polymerizable functional group to cure the compound. Examples of the chain-polymerizable functional group include an acryloyl group, a methacryloyl group, an alkoxysilyl group, and an epoxy group. A reaction for the curing is, for example, radical polymerization, ionic polymerization, thermal polymerization, photopolymerization, radiation polymerization (electron beam polymerization), a plasma chemical vapor deposition (CVD) method, or a photo-CVD method.

The thickness of the protective layer is preferably 0.5 μm or more and 10 μm or less, more preferably 1 μm or more and 7 μm or less. In addition, a conductive particle, a charge transporting material, a lubricant, or the like can be added to the protective layer as required.

In addition, a lubricant, for example, a silicone oil, a wax, a fluorine atom-containing resin particle, such as a polytetrafluoroethylene particle, a silica particle, an alumina particle, or boron nitride may be incorporated into the outermost surface layer (the photosensitive layer, the charge transporting layer, or the protective layer) of the electrophotographic photosensitive member.

In the application of the coating liquid for each layer, there may be used, for example, a coating method, such as a dip coating method, a spray coating method, a spinner coating method, a roller coating method, a Mayer bar coating method, a blade coating method, or a curtain coating method. Of those, a dip coating method is preferred from the viewpoints of efficiency and productivity. The respective layers can be formed on the support by applying and drying the respective layers in a desired order.

[Process Cartridge and Electrophotographic Image Forming Apparatus]

A process cartridge according to one aspect of the present invention integrally supports the electrophotographic photosensitive member described in the foregoing, and at least one device selected from the group consisting of a charging device, a developing device, and a cleaning device, and is removably mounted onto the main body of an electrophotographic image forming apparatus.

In addition, an electrophotographic image forming apparatus according to one aspect of the present invention includes the electrophotographic photosensitive member described in the foregoing, a charging device, an exposing device, a developing device, and a transferring device.

The schematic construction of an electrophotographic image forming apparatus including a process cartridge including the electrophotographic photosensitive member according to one aspect of the present invention is illustrated in FIG. 1.

In FIG. 1, a cylindrical (drum-shaped) electrophotographic photosensitive member 1 is rotationally driven about an axis 2 in a direction indicated by the arrow (clockwise direction) at a predetermined peripheral speed. The surface of the electrophotographic photosensitive member 1 to be rotationally driven is uniformly charged to a predetermined positive or negative potential by a charging device (e.g., a charging roller) 3 in its rotation process. Next, the charged surface of the electrophotographic photosensitive member 1 receives exposure light (image exposure light) 4 whose intensity has been modulated in correspondence with a time-series electric digital image signal of information on a target image output from an exposing device (not shown), such as slit exposure or laser beam scanning exposure. Thus, electrostatic latent images corresponding to the target image are sequentially formed on the surface of the electrophotographic photosensitive member 1.

The electrostatic latent images formed on the surface of the electrophotographic photosensitive member 1 are developed by normal development or reversal development with toner in the developer of a developing device 5 to become toner images. Next, the toner images formed on and carried by the surface of the electrophotographic photosensitive member 1 are sequentially transferred onto a transfer material (e.g., paper) P by a transfer bias from a transferring device (e.g., a transfer roller) 6. The transfer material P is taken out and supplied from a transfer material supplying device (not shown) to a space (abutment portion) between the electrophotographic photosensitive member 1 and the transferring device 6 in synchronization with the rotation of the electrophotographic photosensitive member 1. In addition, a bias voltage opposite in polarity to charge that the toner possesses is applied from a bias power source (not shown) to the transferring device 6.

The transfer material P onto which the toner images have been transferred is separated from the surface of the electrophotographic photosensitive member 1 and conveyed to a fixing device 8 where the toner images are subjected to a fixation treatment. Thus, the transfer material is conveyed as an image-formed product (a print or a copy) to the outside of the apparatus.

The surface of the electrophotographic photosensitive member 1 after the transfer of the toner images is cleaned through the removal of a transfer residual developer (transfer residual toner) by a cleaning device (e.g., a cleaning blade) 7. A cleaner-less system that directly removes the transfer residual toner with a developing unit or the like is also applicable.

Next, the surface is subjected to antistatic treatment by pre-exposure light (not shown) from a pre-exposing device (not shown), and is then repeatedly used in image formation. When the charging device 3 is a contact charging device using a charging roller or the like as illustrated in FIG. 1, pre-exposure is not necessarily needed.

A plurality of components including at least the electrophotographic photosensitive member 1 may be selected from the components, such as the electrophotographic photosensitive member 1, the charging device 3, the developing device 5, and the cleaning device 7, and be stored in a container and integrally supported to form a process cartridge. In addition, the process cartridge may be removably mounted onto the main body of an electrophotographic image forming apparatus, such as a copying machine or a laser beam printer. In FIG. 1, the electrophotographic photosensitive member 1, the charging device 3, the developing device 5, and the cleaning device 7 are integrally supported to form a cartridge, and the cartridge is caused to serve as a process cartridge 9 removably mounted onto the main body of the electrophotographic image forming apparatus by using a guiding device 10, such as the rail of the main body of the electrophotographic image forming apparatus. Although the electrophotographic image forming apparatus illustrated in FIG. 1 includes the cleaning device 7 and the fixing device 8, these devices may not be necessarily arranged.

For example, when the electrophotographic image forming apparatus is a copying machine or a printer, the exposure light 4 is reflected light or transmitted light from an original. Alternatively, the exposure light 4 is light to be applied by, for example, scanning with a laser beam, the driving of an LED array, or the driving of a liquid crystal shutter array to be performed in accordance with a signal obtained by signalizing an original read with a sensor.

According to one aspect of the present invention, there can be provided an electrophotographic photosensitive member that can suppress the deterioration of an image due to a ghost phenomenon while keeping its sensitivity satisfactory, and a method of producing the electrophotographic photosensitive member. In addition, according to another aspect of the present invention, there can be provided a process cartridge and an electrophotographic image forming apparatus that are conducive to the formation of high-quality electrophotographic images.

The present invention is described in more detail below by way of specific Examples. However, the present invention is not limited thereto. The terms "%" and "part(s)" in Examples mean "mass %" and "part(s) by mass", respectively.

—Coating Liquid 1 for Intermediate Layer—

100 Parts of zinc oxide particles (number-average primary particle diameter: 50 nm, specific surface area (hereinafter referred to as "BET value"): 17.2 $m^2/g$, powder resistance: $2.0\times10^7$ Ω·cm) were mixed with 500 parts of toluene under stirring, and 1.0 part of N-2-(aminoethyl)-3-aminopropyltrimethoxysilane (trade name: KBM-603, manufactured by Shin-Etsu Chemical Co., Ltd.) was added to the mixture, followed by stirring for 2 hours. After that, toluene was removed by distillation under reduced pressure and the residue was baked at 120° C. for 3 hours. Thus, surface-treated zinc oxide particles M1 were obtained.

Next, 1.88 parts of polyvinyl butyral (trade name: BM-1, manufactured by Sekisui Chemical Co., Ltd.) and 4.74 parts of a blocked isocyanate (trade name: SUMIDUR BL3175, manufactured by Sumika Covestro Urethane Co., Ltd. (former Sumika Bayer Urethane Co., Ltd.)) were dissolved in a mixed solvent containing 42.5 parts of methyl ethyl ketone and 42.5 parts of 1-butanol. 50.0 Parts of the zinc oxide particles M1 and 1.0 part of the compound 1 serving as a compound represented by the formula (1) were added to the resultant liquid, and the mixture was dispersed with a sand mill apparatus using glass beads each having a diameter of 0.9 mm under an atmosphere at 23±3° C. for 3 hours. After the dispersion, 3.4 parts of silicone particles (trade name: TOSPEARL 120, manufactured by Momentive Performance Materials Inc. (former Toshiba Silicone Co., Ltd.)) serving as resin fine particles and 0.007 part of a silicone oil (trade name: SH28PA, manufactured by Dow Corning Toray Co., Ltd. (former Toray Dow Corning Silicone Co., Ltd.)) were added to the resultant, and the mixture was stirred and then left to stand in a roll stand having a number of revolutions of 60 rpm under an atmosphere at 23±3° C. for 1 day. Thus, a coating liquid 1 for an intermediate layer was prepared.

—Coating Liquids 2 to 28 for Intermediate Layers—

Coating liquids 2 to 28 for intermediate layers were each prepared in the same manner as in the coating liquid 1 for an intermediate layer except that in the coating liquid 1 for an intermediate layer, the kinds and contents of the metal oxide particles and the compound 1 were changed as shown in Table 4. In the coating liquids 25 to 28 for intermediate layers, the metal oxide particles (zinc oxide particles M1) were not used.

—Coating Liquid 29 for Intermediate Layer—

Rutile-type titanium oxide (trade name: PT-401L, manufactured by Ishihara Sangyo Kaisha, Ltd., average primary particle diameter: 130 nm) and 3 mass % of methyldimethoxysilane (trade name: TSL 8117, manufactured by Momentive Performance Materials Japan LLC (former Toshiba Silicone Co., Ltd.)) with respect to the rutile-type titanium oxide were loaded into a high-speed fluid-type mixing kneader (trade name: SMG-300, manufactured by Kawata MFG Co., Ltd.), and were mixed at a rotational peripheral speed as high as 34.5 m/sec to provide surface-treated titanium oxide T1. The resultant surface-treated titanium oxide T1 was dispersed in a mixed solvent containing methanol and 1-propanol with a ball mill. Thus, a dispersed slurry of hydrophobic-treated titanium oxide was obtained.

Methanol, 1-propanol, toluene, and N-methoxymethylated nylon (trade name: TORESIN F-30K, manufactured by Nagase ChemteX Corporation, degree of methoxymethylation: about 30%) powder, and the compound 1 were further added to the dispersed slurry obtained here, and the nylon powder was dissolved by stirring and mixing the contents while warming the contents. After that, an ultrasonic dispersion treatment was performed to finally prepare a dispersion liquid having a solid content concentration of 18 mass %, the solution having a weight ratio "methanol/1-propanol/toluene" of 7/1/2 and containing the hydrophobic-treated titanium oxide, the N-methoxymethylated nylon, and the compound 1 at a weight ratio of 3/1/0.06. The dispersion liquid was defined as a coating liquid 29 for an intermediate layer.

—Coating Liquid 31 for Intermediate Layer—

A coating liquid 31 for an intermediate layer was prepared in the same manner as in the coating liquid 1 for an intermediate layer except that in the coating liquid 1 for an intermediate layer, the compound 1 was not used.

—Coating Liquid 32 for Intermediate Layer—

A coating liquid 32 for an intermediate layer was prepared in the same manner as in the coating liquid 1 for an intermediate layer except that in the coating liquid 1 for an intermediate layer, the compound 1 was changed to 2,3-dihydroxyanthraquinone.

TABLE 4

| Coating liquid | Metal oxide particles | | Compound | |
|---|---|---|---|---|
| for intermediate layer | Kind of particles | Content (part(s)) | Kind | Content (part(s)) |
| Coating liquid 1 | M1 | 50 | Compound 1 | 1.0 |
| Coating liquid 2 | M1 | 50 | Compound 2 | 1.0 |
| Coating liquid 3 | M1 | 50 | Compound 3 | 1.0 |
| Coating liquid 4 | M1 | 50 | Compound 4 | 1.0 |
| Coating liquid 5 | M1 | 50 | Compound 5 | 1.0 |
| Coating liquid 6 | M1 | 50 | Compound 6 | 1.0 |
| Coating liquid 7 | M1 | 50 | Compound 7 | 1.0 |
| Coating liquid 8 | M1 | 50 | Compound 11 | 1.0 |
| Coating liquid 9 | M1 | 50 | Compound 12 | 1.0 |
| Coating liquid 10 | M1 | 50 | Compound 13 | 1.0 |
| Coating liquid 11 | M1 | 50 | Compound 14 | 1.0 |
| Coating liquid 12 | M1 | 50 | Compound 15 | 1.0 |
| Coating liquid 13 | M1 | 50 | Compound 16 | 1.0 |
| Coating liquid 14 | M1 | 50 | Compound 17 | 1.0 |
| Coating liquid 15 | M1 | 50 | Compound 1 | 0.025 |
| Coating liquid 16 | M1 | 50 | Compound 1 | 0.25 |
| Coating liquid 17 | M1 | 50 | Compound 1 | 2.5 |
| Coating liquid 18 | M1 | 50 | Compound 1 | 10 |
| Coating liquid 19 | M1 | 50 | Compound 11 | 0.025 |
| Coating liquid 20 | M1 | 50 | Compound 11 | 0.25 |
| Coating liquid 21 | M1 | 50 | Compound 11 | 2.5 |
| Coating liquid 22 | M1 | 50 | Compound 11 | 10 |
| Coating liquid 23 | M1 | 30 | Compound 11 | 1.0 |
| Coating liquid 24 | M1 | 70 | Compound 1 | 1.0 |

TABLE 4-continued

| Coating liquid | Metal oxide particles | | Compound | |
|---|---|---|---|---|
| for intermediate layer | Kind of particles | Content (part(s)) | Kind | Content (part(s)) |
| Coating liquid 25 | — | — | Compound 1 | 1.0 |
| Coating liquid 26 | — | — | Compound 1 | 0.025 |
| Coating liquid 27 | — | — | Compound 1 | 0.25 |
| Coating liquid 28 | — | — | Compound 1 | 2.5 |
| Coating liquid 29 | T1 | 50 | Compound 1 | 1.0 |
| Coating liquid 31 | M1 | 50 | — | — |
| Coating liquid 32 | M1 | 50 | 2,3-Dihydroxyanthraquinone | 1.0 |

—Coating Liquid 41 for Intermediate Layer—

10 Parts of polyvinyl butyral (trade name: BM-1) was dissolved in a mixed solvent containing 42.5 parts of methyl ethyl ketone and 42.5 parts of 1-butanol. Next, 0.15 part of the compound 18 serving as a compound represented by the formula (3) was added to the solution, and the mixture was left to stand in a roll stand having a number of revolutions of 60 rpm under an atmosphere at 23±3° C. for 1 day. Thus, a coating liquid 41 for an intermediate layer was prepared.

—Coating Liquids 42 to 53 for Intermediate Layers—

Coating liquids 42 to 53 for intermediate layers were each prepared in the same manner as in the coating liquid 41 for an intermediate layer except that in the coating liquid 41 for an intermediate layer, a compound shown in Table 5 whose blending amount was also shown in the table was used instead of 0.15 part of the compound 18.

—Coating Liquid 54 for Intermediate Layer—

A coating liquid 54 for an intermediate layer was prepared in the same manner as in the coating liquid 41 for an intermediate layer except that in the coating liquid 41 for an intermediate layer, 2.85 parts of polyvinyl butyral (trade name: BM-1) and 7.15 parts of a blocked isocyanate (SUMIDUR BL3175) were used instead of 10 parts of the polyvinyl butyral (trade name: BM-1).

—Coating Liquid 55 for Intermediate Layer—

A coating liquid 55 for an intermediate layer was prepared in the same manner as in the coating liquid 41 for an intermediate layer except that in the coating liquid 41 for an intermediate layer, 10 parts of a phenol resin (trade name: J-325, manufactured by DIC Corporation) was used instead of 10 parts of the polyvinyl butyral (trade name: BM-1), and a mixed solvent containing 42.5 parts of methanol and 42.5 parts of 1-methoxypropanol was used instead of the mixed solvent containing 42.5 parts of methyl ethyl ketone and 42.5 parts of 1-butanol.

TABLE 5

| | Compound | | Binder resin | | Mixed solvent | |
|---|---|---|---|---|---|---|
| Coating liquid for intermediate layer | Kind | Content (part(s)) | Kind | Content (part(s)) | Kind | Content (part(s)) |
| Coating liquid 41 | Compound 18 | 0.15 | BM-1 | 10 | Methyl ethyl ketone<br>1-Butanol | 42.5<br>42.5 |
| Coating liquid 42 | Compound 19 | 0.15 | BM-1 | 10 | Methyl ethyl ketone<br>1-Butanol | 42.5<br>42.5 |
| Coating liquid 43 | Compound 22 | 0.15 | BM-1 | 10 | Methyl ethyl ketone<br>1-Butanol | 42.5<br>42.5 |
| Coating liquid 44 | Compound 27 | 0.15 | BM-1 | 10 | Methyl ethyl ketone<br>1-Butanol | 42.5<br>42.5 |
| Coating liquid 45 | Compound 30 | 0.15 | BM-1 | 10 | Methyl ethyl ketone<br>1-Butanol | 42.5<br>42.5 |
| Coating liquid 46 | Compound 29 | 0.15 | BM-1 | 10 | Methyl ethyl ketone<br>1-Butanol | 42.5<br>42.5 |

TABLE 5-continued

| Coating liquid for intermediate layer | Compound Kind | Compound Content (part(s)) | Binder resin Kind | Binder resin Content (part(s)) | Mixed solvent Kind | Mixed solvent Content (part(s)) |
|---|---|---|---|---|---|---|
| Coating liquid 47 | Compound 24 | 0.15 | BM-1 | 10 | Methylethyl ketone<br>1-Butanol | 42.5<br>42.5 |
| Coating liquid 48 | Compound 25 | 0.15 | BM-1 | 10 | Methyl ethyl ketone<br>1-Butanol | 42.5<br>42.5 |
| Coating liquid 49 | Compound 26 | 0.15 | BM-1 | 10 | Methyl ethyl ketone<br>1-Butanol | 42.5<br>42.5 |
| Coating liquid 50 | Compound 19 | 0.005 | BM-1 | 10 | Methyl ethyl ketone<br>1-Butanol | 42.5<br>42.5 |
| Coating liquid 51 | Compound 19 | 0.05 | BM-1 | 10 | Methyl ethyl ketone<br>1-Butanol | 42.5<br>42.5 |
| Coating liquid 52 | Compound 19 | 0.5 | BM-1 | 10 | Methyl ethyl ketone<br>1-Butanol | 42.5<br>42.5 |
| Coating liquid 53 | Compound 19 | 1 | BM-1 | 10 | Methyl ethyl ketone<br>1-Butanol | 42.5<br>42.5 |
| Coating liquid 54 | Compound 19 | 0.15 | BM-1<br>SUMIDUR BL3175 | 2.85<br>7.15 | Methyl ethyl ketone<br>1-Butanol | 42.5<br>42.5 |
| Coating liquid 55 | Compound 19 | 0.15 | J-325 | 10 | Methanol<br>1-Methoxypropanol | 42.5<br>42.5 |

—Coating Liquid 56 for Intermediate Layer—

Surface-treated zinc oxide particles M2 were obtained in the same manner as in the production of the zinc oxide particles M1 in the coating liquid 1 for an intermediate layer except that in the production of the zinc oxide particles M1, 100 parts of zinc oxide particles (number-average primary particle diameter: 50 nm, BET value: 19 $m^2/g$, powder resistance: $2.5\times10^7$ Ω·cm) were used instead of 100 parts of the zinc oxide particles (number-average primary particle diameter: 50 nm, specific surface area: 17.2 $m^2/g$, powder resistance: $2.0\times10^7$ Ω·cm).

Next, a coating liquid 56 for an intermediate layer was prepared in the same manner as in the preparation of the coating liquid 1 for an intermediate layer except that 50 parts of the zinc oxide particles M2 were used instead of 50 parts of the zinc oxide particles M1 in the coating liquid 1 for an intermediate layer, and 1.0 part of the compound 18 serving as a compound represented by the formula (3) was used instead of 1.0 part of the compound 1 serving as a compound represented by the formula (1) in the coating liquid.

—Coating Liquids 57 to 74 for Intermediate Layers—

Coating liquids 57 to 74 for intermediate layers were each prepared in the same manner as in the coating liquid 56 for an intermediate layer except that in the coating liquid 56 for an intermediate layer, the kinds and contents of the zinc oxide particles M2 serving as metal oxide particles and the compound 18 serving as a compound represented by the formula (3) were changed as shown in Table 6.

TABLE 6

| Coating liquid for intermediate layer | Metal oxide particles Kind of particles | Metal oxide particles Content (part(s)) | Compound Kind | Compound Content (part(s)) |
|---|---|---|---|---|
| Coating liquid 56 | M2 | 50 | Compound 18 | 1.0 |
| Coating liquid 57 | M2 | 50 | Compound 19 | 1.0 |
| Coating liquid 58 | M2 | 50 | Compound 20 | 1.0 |
| Coating liquid 59 | M2 | 50 | Compound 21 | 1.0 |

TABLE 6-continued

| Coating liquid for intermediate layer | Metal oxide particles Kind of particles | Metal oxide particles Content (part(s)) | Compound Kind | Compound Content (part(s)) |
|---|---|---|---|---|
| Coating liquid 60 | M2 | 50 | Compound 28 | 1.0 |
| Coating liquid 61 | M2 | 50 | Compound 27 | 1.0 |
| Coating liquid 62 | M2 | 50 | Compound 23 | 1.0 |
| Coating liquid 63 | M2 | 50 | Compound 29 | 1.0 |
| Coating liquid 64 | M2 | 50 | Compound 25 | 1.0 |
| Coating liquid 65 | M2 | 50 | Compound 26 | 1.0 |
| Coating liquid 66 | M2 | 50 | Compound 19 | 0.025 |
| Coating liquid 67 | M2 | 50 | Compound 19 | 0.25 |
| Coating liquid 68 | M2 | 50 | Compound 19 | 2.5 |
| Coating liquid 69 | M2 | 50 | Compound 19 | 10 |
| Coating liquid 70 | M3 | 50 | Compound 19 | 1.0 |
| Coating liquid 71 | M4 | 50 | Compound 19 | 1.0 |
| Coating liquid 72 | M5 | 50 | Compound 19 | 1.0 |
| Coating liquid 73 | M6 | 50 | Compound 19 | 1.0 |
| Coating liquid 74 | M7 | 50 | Compound 19 | 1.0 |

The symbols "M3" to "M7" in Table 6 each represent metal oxide particles, and the symbols specifically represent the following particles.

The symbol "M3" represents the zinc oxide particles M3. The zinc oxide particles M3 were obtained by treating the surfaces of zinc oxide particles having a number-average primary particle diameter of 35 nm in the same manner as in the production of the zinc oxide particles M2.

The symbol "M4" represents the titanium oxide particles M4. The titanium oxide particles M4 were obtained by treating the surfaces of titanium oxide particles having a number-average primary particle diameter of 50 nm in the same manner as in the production of the zinc oxide particles M2.

The symbol "M5" represents the titanium oxide particles M5. The titanium oxide particles M5 were obtained by treating the surfaces of titanium oxide particles having a number-average primary particle diameter of 100 nm in the same manner as in the production of the zinc oxide particles M2.

The symbol "M6" represents the titanium oxide particles M6. The titanium oxide particles M6 were obtained by treating the surfaces of titanium oxide particles having a number-average primary particle diameter of 200 nm in the same manner as in the production of the zinc oxide particles M2.

The symbol "M7" represents the tin oxide particles M7. The tin oxide particles M7 were obtained by treating the surfaces of tin oxide particles having a number-average primary particle diameter of 50 nm in the same manner as in the production of the zinc oxide particles M2.

—Coating Liquids 81 and 82 for Intermediate Layers—

Coating liquids 81 and 82 for intermediate layers were prepared in the same manner as in the coating liquids 41 and 56 for intermediate layers except that in the coating liquids 41 and 56 for intermediate layers, the compound 18 serving as a compound represented by the formula (3) was not used.

—Coating Liquids 83 and 84 for Intermediate Layers—

Coating liquids 83 and 84 for intermediate layers were prepared in the same manner as in the coating liquid 41 for an intermediate layer except that in the coating liquid 41 for an intermediate layer, 4-hydroxyfluorenone and 2,3-dihydroxyanthraquinone were used, respectively instead of the compound 18 serving as a compound represented by the formula (3).

Example 1

An aluminum cylinder having a diameter of 24 mm (JIS-A3003, aluminum alloy, length: 257.5 mm) was used as a support (conductive support).

Next, the coating liquid 1 for an intermediate layer was applied onto the support by immersion to form a coat, and the resultant coat was dried for 20 minutes at 170° C. to form an intermediate layer having a thickness of 30 μm.

Next, a hydroxygallium phthalocyanine crystal (charge generating material) of a crystal form having peaks at Bragg angles (2θ±0.2°) in CuKα characteristic X-ray diffraction of 7.5°, 9.9°, 12.5°, 16.3°, 18.6°, 25.1°, and 28.3° was provided. 10 Parts of the hydroxygallium phthalocyanine crystal, 0.1 part of a compound represented by the structural formula (A), 5 parts of polyvinyl butyral (trade name: S-LEC BX-1, manufactured by Sekisui Chemical Co., Ltd.), and 250 parts of cyclohexanone were loaded into a sand mill using glass beads each having a diameter of 0.8 mm, and the mixture was subjected to a dispersion treatment for 1.5 hours. Next, 250 parts of ethyl acetate were added to the resultant to prepare a coating liquid for a charge generating layer.

Structural formula (A)

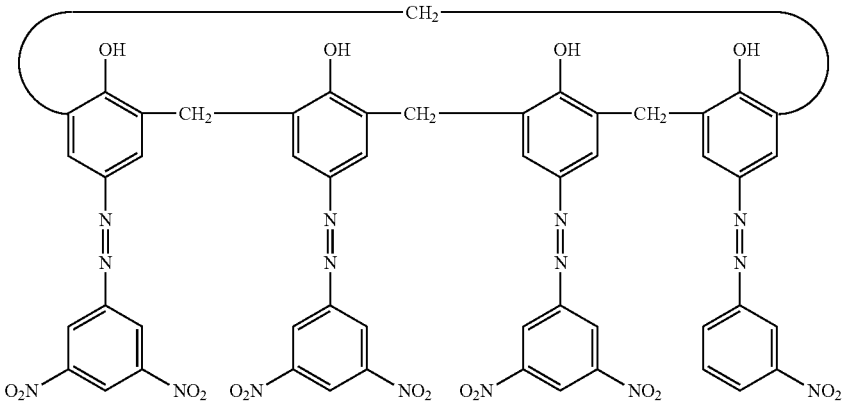

The coating liquid for a charge generating layer was applied onto the intermediate layer by immersion to form a coat, and the resultant coat was dried for 10 minutes at 100° C. to form a charge generating layer having a thickness of 0.15 μm.

Next, 4 parts of a triarylamine compound represented by the structural formula (CTM-1), 4 parts of a benzidine compound represented by the structural formula (CTM-2), and 10 parts of bisphenol Z-type polycarbonate (trade name: PCZ-400, manufactured by Mitsubishi Gas Chemical Company, Inc.) were dissolved in a mixed solvent containing 40 parts of dimethoxymethane and 60 parts of chlorobenzene to prepare a coating liquid for a hole transporting layer (charge transporting layer). The coating liquid for a hole transporting layer was applied onto the charge generating layer by immersion, and the resultant coat was dried for 35 minutes at 120° C. to form a hole transporting layer (charge transporting layer) having a thickness of 18 μm.

Structural formula (CTM-1)

(CTM-1)

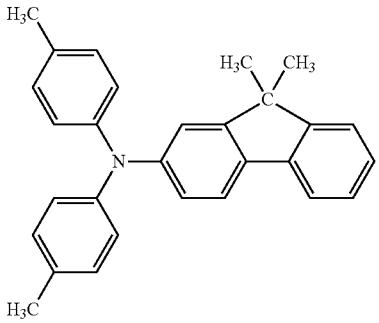

Structural formula (CTM-2)

(CTM-2)

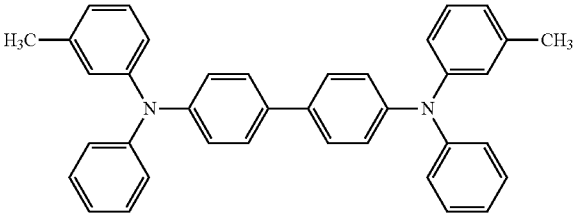

Thus, an electrophotographic photosensitive member for an evaluation was produced. A ghost evaluation and a sensitivity evaluation are described below.

(Ghost Evaluation)

An evaluation was performed by mounting the produced electrophotographic photosensitive member for an evaluation on a reconstructed machine of a laser beam printer (trade name: LBP7700C) manufactured by Canon Inc. Details about the evaluation are as described below.

The printer was reconstructed so as to operate while pre-exposure was not turned on, and a charging condition and a laser exposure were variable. In addition, the produced electrophotographic photosensitive member was mounted on a process cartridge for a cyan color, and the resultant was attached to the station of the process cartridge for a cyan color.

The surface potential of the drum (drum-shaped electrophotographic photosensitive member) was set under an environment having a temperature of 22° C. and a humidity of 30% RH so that an initial dark portion potential became −570 V and an initial light portion potential became −100 V. Surface potential measurement at the time of the potential setting was performed as described below. The cartridge was reconstructed and a potential probe (trade name: model 6000B-8, manufactured by TREK JAPAN) was mounted at a development position, followed by the measurement of a potential at the central portion of the drum with a surface potentiometer (trade name: model 344, manufactured by TREK JAPAN).

Figure 3:
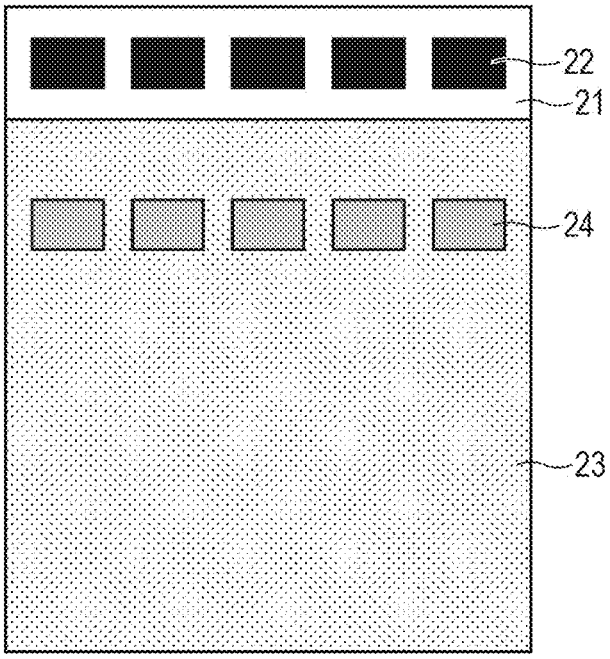
FIG. 3 is a view for describing a printing for a ghost evaluation to be used at the time of a ghost image evaluation.

Such an image for a ghost evaluation as illustrated in FIG. 3 was used in a ghost image evaluation. The image for a ghost evaluation is obtained by: outputting a quadrangular solid image 22 in a white ground (white image 21) in the leading end portion of an image; and then producing a halftone image 23 of a one-dot keima pattern. In FIG. 3, a ghost portion 24 is a portion where a ghost resulting from the solid image 22 may appear. That is, the position at which after a portion on the photosensitive member corresponding to the solid image 22 has transferred the solid image 22, the photosensitive member rotates to transfer an image (part of the halftone image 23 of a one-dot keima pattern) again is the ghost portion 24. Therefore, when a ghost appears, the ghost appears at the position of the ghost portion 24 in FIG. 3.

The ghost evaluation was performed in the following order. A white image was output on a first sheet, and then the image for a ghost evaluation was continuously output on 5 sheets, followed by the performance of the evaluation. The evaluation of the image for a ghost evaluation was performed as described below. A density difference between the image density of the one-dot keima pattern image and the image density of the ghost portion was measured with a spectral densitometer (trade name: X-Rite 504/508, manufactured by X-Rite Inc.) at 5 sites in one image for a ghost evaluation, and the average of the values measured at the 5 sites was calculated and defined as a result for the one image. All the 5 images for ghost evaluations were similarly subjected to the measurement, and the average of the measured values (25 sites) was determined. The result is shown in Table 7. A smaller value for the density difference means that the photosensitive member is more excellent in suppression of a ghost. The case where a value for the density difference was 0.04 or more was judged to be at the level at which the suppression of a ghost was not sufficient and hence an effect of the present invention was not obtained.

(Sensitivity Evaluation)

An evaluation was performed by mounting the produced electrophotographic photosensitive member for an evaluation on a reconstructed machine of a laser beam printer (trade name: LBP7700C, manufactured by Canon Inc.) subjected to the same reconstruction as in the ghost evaluation. Details about the evaluation are as described below.

The surface potential of the drum was set under an environment having a temperature of 22° C. and a humidity of 30% RH so that an initial dark portion potential became −570 V. Surface potential measurement at the time of the potential setting was performed as described below. The cartridge was reconstructed and a potential probe (trade name: model 6000B-8, manufactured by TREK JAPAN) was mounted at a development position, followed by the measurement of a potential at the central portion of the drum with a surface potentiometer (trade name: model 344, manufactured by TREK JAPAN).

The sensitivity evaluation was performed by measuring the surface potential of the drum at the time of the printing of a solid image with an exposure light quantity of 0.38 $\mu J/cm^2$. The result is shown in Table 7. A smaller absolute value of the surface potential means that the photosensitive member is more excellent in sensitivity.

Examples 2 to 25

Electrophotographic photosensitive members were each produced and evaluated in the same manner as in Example 1 except that in Example 1, the coating liquid 1 for an intermediate layer was changed as shown in Table 7. The results of the evaluations are shown in Table 7.

Comparative Examples 1 to 6

Electrophotographic photosensitive members were each produced and evaluated in the same manner as in Example 1 except that in Example 1, the coating liquid 1 for an intermediate layer was changed as shown in Table 7. The results of the evaluations are shown in Table 7.

TABLE 7

| Example number | Coating liquid for intermediate layer | Ghost image evaluation | Sensitivity (V) |
|---|---|---|---|
| Example 1 | Coating liquid 1 | 0.022 | −103 |
| Example 2 | Coating liquid 2 | 0.021 | −101 |
| Example 3 | Coating liquid 3 | 0.031 | −113 |
| Example 4 | Coating liquid 4 | 0.033 | −116 |
| Example 5 | Coating liquid 5 | 0.029 | −110 |
| Example 6 | Coating liquid 6 | 0.023 | −103 |
| Example 7 | Coating liquid 7 | 0.031 | −115 |
| Example 8 | Coating liquid 8 | 0.024 | −104 |
| Example 9 | Coating liquid 9 | 0.023 | −102 |
| Example 10 | Coating liquid 10 | 0.032 | −114 |
| Example 11 | Coating liquid 11 | 0.033 | −114 |
| Example 12 | Coating liquid 12 | 0.030 | −109 |
| Example 13 | Coating liquid 13 | 0.020 | −101 |
| Example 14 | Coating liquid 14 | 0.034 | −115 |
| Example 15 | Coating liquid 15 | 0.029 | −126 |
| Example 16 | Coating liquid 16 | 0.026 | −117 |
| Example 17 | Coating liquid 17 | 0.023 | −102 |
| Example 18 | Coating liquid 18 | 0.020 | −100 |
| Example 19 | Coating liquid 19 | 0.027 | −123 |
| Example 20 | Coating liquid 20 | 0.024 | −117 |
| Example 21 | Coating liquid 21 | 0.022 | −100 |
| Example 22 | Coating liquid 22 | 0.020 | −98 |
| Example 23 | Coating liquid 23 | 0.024 | −110 |
| Example 24 | Coating liquid 24 | 0.021 | −98 |
| Example 25 | Coating liquid 29 | 0.023 | −104 |
| Comparative Example 1 | Coating liquid 25 | 0.048 | −138 |
| Comparative Example 2 | Coating liquid 26 | 0.046 | −137 |
| Comparative Example 3 | Coating liquid 27 | 0.041 | −136 |
| Comparative Example 4 | Coating liquid 28 | 0.042 | −134 |
| Comparative Example 5 | Coating liquid 31 | 0.093 | −138 |
| Comparative Example 6 | Coating liquid 32 | 0.041 | −151 |

Examples 26 to 44 and Comparative Examples 7 to 25

Electrophotographic photosensitive members were each produced in the same manner as in Example 1 except that in Example 1, points described in the following (1) to (4) were changed:

(1): the length of the aluminum cylinder was changed from 257.5 mm to 261.5 mm;

(2): a coating liquid for an intermediate layer shown in Table 8 was used instead of the coating liquid 1 for an intermediate layer;

(3): the thickness of the formed intermediate layer was changed from 30 μm to a thickness shown in Table 8; and (4): instead of the formation of the hole transporting layer (charge transporting layer) having a thickness of 18 μm through the application of the coating liquid for a hole transporting layer onto the charge generating layer by immersion, and the drying of the resultant coat for 35 minutes at 120° C., a hole transporting layer having a thickness of 15 μm was formed by applying the coating liquid for a hole transporting layer onto the charge generating layer by immersion, and drying the resultant coat for 40 minutes at 120° C.

Thus, an electrophotographic photosensitive member for an evaluation was produced. A ghost evaluation and a sensitivity evaluation are described below.

(Ghost Evaluation)

The produced electrophotographic photosensitive members for evaluations were each evaluated in the same manner as in Example 1 except that in the ghost evaluation of Example 1, the evaluation was performed under an environment having a temperature of 23° C. and a humidity of 40% RH instead of the environment having a temperature of 22° C. and a humidity of 30% RH, and the surface potential of the electrophotographic photosensitive member was set so that an initial dark portion potential became −500 V and an initial light portion potential became −90 V instead of being set so that the initial dark portion potential became −570 V and the initial light portion potential became −100 V.

(Sensitivity Evaluation)

An evaluation was performed by mounting the produced electrophotographic photosensitive member for an evaluation on a reconstructed machine of a laser beam printer (trade name: CP3525dn, manufactured by Hewlett-Packard Japan, Ltd.). Details about the evaluation are as described below.

The printer was reconstructed so as to operate while pre-exposure was not turned on, and a charging condition and a laser exposure were variable. In addition, the produced electrophotographic photosensitive member was mounted on a process cartridge for a cyan color, and the resultant was attached to the station of the process cartridge for a cyan color.

The surface potential of the drum was set under an environment having a temperature of 23° C. and a humidity of 40% RH so that an initial dark portion potential became −500 V. Surface potential measurement at the time of the potential setting was performed as described below. The cartridge was reconstructed and a potential probe (trade name: model 6000B-8, manufactured by TREK JAPAN) was mounted at a development position, followed by the measurement of a potential at the central portion of the drum with a surface potentiometer (trade name: model 344, manufactured by TREK JAPAN).

The sensitivity evaluation was performed by measuring the surface potential of the drum at the time of the printing of a solid image with an exposure light quantity of 0.30 $\mu J/cm^2$. The result is shown in Table 8. A smaller absolute value of the surface potential means that the photosensitive member is more excellent in sensitivity.

TABLE 8

| Example number | Coating liquid for intermediate layer | Thickness (μm) | Ghost image evaluation | Sensitivity (V) |
|---|---|---|---|---|
| Example 26 | Coating liquid 56 | 30 | 0.032 | −113 |
| Example 27 | Coating liquid 57 | 30 | 0.021 | −100 |
| Example 28 | Coating liquid 58 | 30 | 0.022 | −104 |
| Example 29 | Coating liquid 59 | 30 | 0.020 | −98 |
| Example 30 | Coating liquid 60 | 30 | 0.021 | −98 |
| Example 31 | Coating liquid 61 | 30 | 0.022 | −98 |
| Example 32 | Coating liquid 62 | 30 | 0.028 | −108 |
| Example 33 | Coating liquid 63 | 30 | 0.028 | −110 |
| Example 34 | Coating liquid 64 | 30 | 0.034 | −112 |
| Example 35 | Coating liquid 65 | 30 | 0.033 | −114 |
| Example 36 | Coating liquid 66 | 30 | 0.038 | −115 |
| Example 37 | Coating liquid 67 | 30 | 0.021 | −100 |
| Example 38 | Coating liquid 68 | 30 | 0.021 | −102 |
| Example 39 | Coating liquid 69 | 30 | 0.039 | −126 |
| Example 40 | Coating liquid 70 | 30 | 0.021 | −103 |
| Example 41 | Coating liquid 71 | 30 | 0.021 | −99 |
| Example 42 | Coating liquid 72 | 30 | 0.022 | −101 |
| Example 43 | Coating liquid 73 | 30 | 0.022 | −100 |
| Example 44 | Coating liquid 74 | 30 | 0.020 | −102 |
| Comparative Example 7 | Coating liquid 41 | 15 | 0.048 | −139 |
| Comparative Example 8 | Coating liquid 42 | 15 | 0.041 | −136 |
| Comparative Example 9 | Coating liquid 43 | 15 | 0.042 | −132 |
| Comparative Example 10 | Coating liquid 44 | 15 | 0.044 | −134 |
| Comparative Example 11 | Coating liquid 45 | 15 | 0.043 | −137 |
| Comparative Example 12 | Coating liquid 46 | 15 | 0.049 | −137 |
| Comparative Example 13 | Coating liquid 47 | 15 | 0.041 | −134 |
| Comparative Example 14 | Coating liquid 48 | 15 | 0.049 | −133 |
| Comparative Example 15 | Coating liquid 49 | 15 | 0.048 | −134 |
| Comparative Example 16 | Coating liquid 50 | 15 | 0.046 | −138 |
| Comparative Example 17 | Coating liquid 51 | 15 | 0.040 | −131 |
| Comparative Example 18 | Coating liquid 52 | 15 | 0.040 | −131 |
| Comparative Example 19 | Coating liquid 53 | 15 | 0.048 | −139 |
| Comparative Example 20 | Coating liquid 54 | 15 | 0.040 | −132 |
| Comparative Example 21 | Coating liquid 55 | 15 | 0.041 | −133 |
| Comparative Example 22 | Coating liquid 81 | 15 | 0.108 | −141 |
| Comparative Example 23 | Coating liquid 82 | 30 | 0.099 | −140 |
| Comparative Example 24 | Coating liquid 83 | 30 | 0.060 | −147 |

TABLE 8-continued

| Example number | Coating liquid for intermediate layer | Thickness (μm) | Ghost image evaluation | Sensitivity (V) |
|---|---|---|---|---|
| Comparative Example 25 | Coating liquid 84 | 30 | 0.055 | −150 |

(Verification Method for Complex State)

Verification Method in Paint

Verification that a compound formed a complex with a metal oxide in a paint (coating liquid for an intermediate layer) was performed by the following method.

A paint for an intermediate layer (coating liquid for an intermediate layer) was prepared, and the paint was diluted with a dispersion solvent for an intermediate layer so as to have a concentration 1/100 that before the dilution. A UV spectrum measured by dissolving a compound with the dispersion solvent for an intermediate layer and a UV spectrum measured by diluting the paint for an intermediate layer were compared to each other. In each of the coating liquids 1 to 24, 29 and 56 to 74 for intermediate layers, a peak of the latter UV spectrum shifted to longer wavelengths and hence it was confirmed that a complex was formed.

Verification Method in Photosensitive Member

Verification that a compound formed a complex with a metal oxide was performed by the following method.

A film having a width of 1 cm, a height of 3 cm, and a thickness of 0.3 μm was cut out of an intermediate layer, and the UV spectrum of the resultant film was obtained. Then, the UV spectrum of the very compound represented by any one of the general formulae (1) to (3) used in the intermediate layer, and the UV spectrum of the film were compared to each other. In each of the electrophotographic photosensitive members obtained in Examples 1 to 44, a peak of the latter UV spectrum shifted to longer wavelengths and hence it was confirmed that a complex was formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-075479, filed Apr. 4, 2016, and Japanese Patent Application No. 2016-122851, filed Jun. 21, 2016, which are hereby incorporated by reference herein in their entirety.

What is claimed is:

1. An electrophotographic photosensitive member, comprising:

a support;

an intermediate layer on the support; and a photosensitive layer on the intermediate layer, wherein the intermediate layer contains a metal oxide and at least one compound selected from the group consisting of a compound represented by formula (2), and a compound represented by formula (3):

(2)

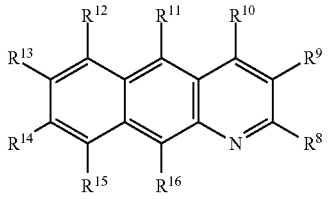

where $R^8$ to $R^{16}$ each independently represent a hydrogen atom, an alkyl group, a hydroxy group, a carboxy group, an amino group, an alkoxy group, or a substituted or unsubstituted aryl group, and a substituent of the substituted aryl group is an alkyl group, an aryl group, a halogen atom, a hydroxy group, or a carboxy group;

(3)

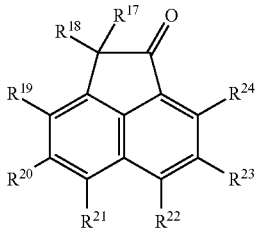

where $R^{17}$ to $R^{24}$ each independently represent a hydrogen atom, a substituted or unsubstituted alkyl group, a hydroxy group, a carboxy group, an amino group, an alkoxy group, a group obtained by substituting one carbon atom in a main chain of the alkyl group with an oxygen atom, or a group obtained by substituting one carbon atom in the main chain of the alkyl group with a nitrogen atom, and a substituent of the substituted alkyl group is an alkyl group, an aryl group, a halogen atom, or a carbonyl group.

2. The electrophotographic photosensitive member according to claim 1, wherein a content of the compound represented by formula (2), and the compound represented by formula (3) is 0.1 to 50 mass % with respect to a total mass of the intermediate layer.

3. The electrophotographic photosensitive member according to claim 1, wherein the at least one compound represented by formula (2), and the compound represented by formula (3) forms a complex with the metal oxide.

4. The electrophotographic photosensitive member according to claim 1, wherein the metal oxide comprises a particle containing zinc oxide, titanium oxide, or tin oxide.

5. The electrophotographic photosensitive member according to claim 1, wherein a content of the at least one compound represented by formula (2), and formula (3) is 0.05 to 20 mass % with respect to the metal oxide in the intermediate layer.

6. The electrophotographic photosensitive member according to claim 1, wherein at least one of $R^8$ to $R^{16}$, or at least one of $R^{17}$ to $R^{24}$ represents a hydroxy group or a carboxy group.

7. The electrophotographic photosensitive member according to claim 1, wherein $R^8$ to $R^{16}$, or $R^{17}$ to $R^{24}$ each independently represent a hydrogen atom, a hydroxy group, or a carboxy group.

8. The electrophotographic photosensitive member according to claim 1, wherein at least one of $R^{15}$, $R^{17}$, $R^{18}$, and $R^{24}$ represents a hydroxy group or a carboxy group.

9. A method of producing the electrophotographic photosensitive member according to claim 1, the method comprising:

forming, on the support, a coat of a coating liquid for the intermediate layer containing a metal oxide and at least one compound selected from the group consisting of a compound represented by formula (2), and a compound represented by formula (3);

drying the coat to form the intermediate layer; and forming the photosensitive layer on the intermediate layer:

(2)

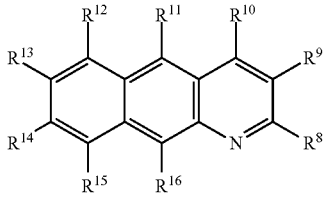

where $R^8$ to $R^{16}$ each independently represent a hydrogen atom, an alkyl group, a hydroxy group, a carboxy group, an amino group, an alkoxy group, or a substituted or unsubstituted aryl group, and a substituent of the substituted aryl group is an alkyl group, an aryl group, a halogen atom, a hydroxy group, or a carboxy group;

(3)

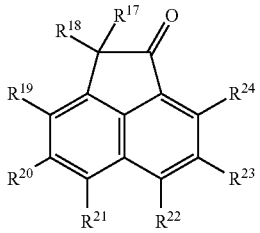

where $R^{17}$ to $R^{24}$ each independently represent a hydrogen atom, a substituted or unsubstituted alkyl group, a hydroxy group, a carboxy group, an amino group, an alkoxy group, a group obtained by substituting one carbon atom in a main chain of the alkyl group with an oxygen atom, or a group obtained by substituting one carbon atom in the main chain of the alkyl group with a nitrogen atom, and a substituent of the substituted alkyl group is an alkyl group, an aryl group, a halogen atom, or a carbonyl group.

10. A process cartridge, comprising:

an electrophotographic photosensitive member; and at least one device selected from the group consisting of a charging device, a developing device, and a cleaning device, the process cartridge integrally supporting the electrophotographic photosensitive member and the at least one device, and being removably mounted onto a main body of an electrophotographic image forming apparatus, wherein the electrophotographic photosensitive member comprises a support, an intermediate layer on the support, and a photosensitive layer on the intermediate layer; and the intermediate layer contains a metal oxide and at least one compound selected from the group consisting of a compound represented by formula (1), a compound represented by formula (2), and a compound represented by formula (3):

(1)

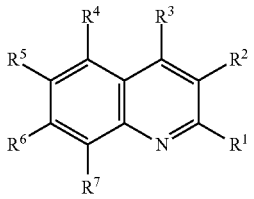

where $R^1$ to $R^7$ each independently represent a hydrogen atom, an alkyl group, a hydroxy group, a carboxy group, an amino group, an alkoxy group, or a substituted or unsubstituted aryl group, and a substituent of the substituted aryl group is an alkyl group, an aryl group, a halogen atom, a hydroxy group, or a carboxy group, and at least one of $R^1$ to $R^7$ represents a carboxy group;

(2)

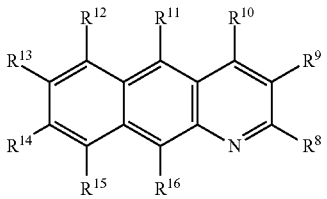

where $R^8$ to $R^{16}$ each independently represent a hydrogen atom, an alkyl group, a hydroxy group, a carboxy group, an amino group, an alkoxy group, or a substituted or unsubstituted aryl group, and a substituent of the substituted aryl group is an alkyl group, an aryl group, a halogen atom, a hydroxy group, or a carboxy group;

(3)

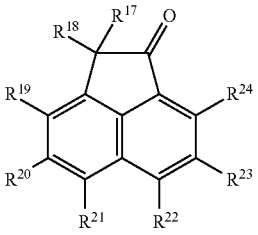

where $R^{17}$ to $R^{24}$ each independently represent a hydrogen atom, a substituted or unsubstituted alkyl group, a hydroxy group, a carboxy group, an amino group, an alkoxy group, a group obtained by substituting one carbon atom in a main chain of the alkyl group with an oxygen atom, or a group obtained by substituting one carbon atom in the main chain of the alkyl group with a nitrogen atom, and a substituent of the substituted alkyl group is an alkyl group, an aryl group, a halogen atom, or a carbonyl group.

11. An electrophotographic image forming apparatus, comprising:

an electrophotographic photosensitive member;

a charging device;

an exposing device;

a developing device; and a transferring device, wherein the electrophotographic photosensitive member comprises a support, an intermediate layer on the support, and a photosensitive layer on the intermediate layer, and the intermediate layer contains a metal oxide and at least one compound selected from the group consisting of a compound represented by formula (1), a compound represented by formula (2), and a compound represented by formula (3):

(1)

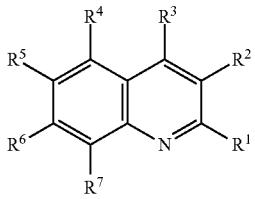

where $R^1$ to $R^7$ each independently represent a hydrogen atom, an alkyl group, a hydroxy group, a carboxy group, an amino group, an alkoxy group, or a substituted or unsubstituted aryl group, and a substituent of the substituted aryl group is an alkyl group, an aryl group, a halogen atom, a hydroxy group, or a carboxy group, and at least one of $R^1$ to $R^7$ represents a carboxy group;

(2)

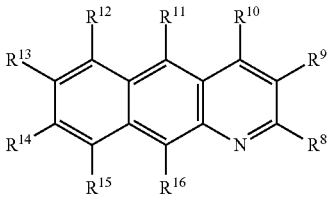

where $R^8$ to $R^{16}$ each independently represent a hydrogen atom, an alkyl group, a hydroxy group, a carboxy group, an amino group, an alkoxy group, or a substituted or unsubstituted aryl group, and a substituent of the substituted aryl group is an alkyl group, an aryl group, a halogen atom, a hydroxy group, or a carboxy group;

General formula (3)

(3)

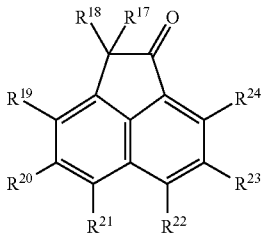

where $R^{17}$ to $R^{24}$ each independently represent a hydrogen atom, a substituted or unsubstituted alkyl group, a hydroxy group, a carboxy group, an amino group, an alkoxy group, a group obtained by substituting one carbon atom in a main chain of the alkyl group with an oxygen atom, or a group obtained by substituting one carbon atom in the main chain of the alkyl group with a nitrogen atom, and a substituent of the substituted alkyl group is an alkyl group, an aryl group, a halogen atom, or a carbonyl group.

12. An electrophotographic photosensitive member, comprising:

a support;

an intermediate layer on the support; and a photosensitive layer on the intermediate layer, wherein the intermediate layer contains a metal oxide and a compound represented by formula (1):

(1)

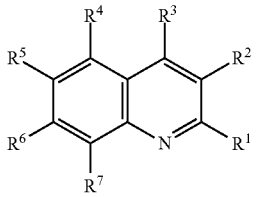

where $R^1$ to $R^7$ each independently represent a hydrogen atom, an alkyl group, a hydroxy group, a carboxy group, an amino group, an alkoxy group, or a substituted or unsubstituted aryl group, and a substituent of the substituted aryl group is an alkyl group, an aryl group, a halogen atom, a hydroxy group, or a carboxy group, and at least one of $R^1$ to $R^7$ represents a carboxy group.

13. The electrophotographic photosensitive member according to claim 12, wherein the compound represented by formula (1) forms a complex with the metal oxide.

14. The electrophotographic photosensitive member according to claim 12, wherein a content of the compound represented by formula (1) is 0.05 to 20 mass % with respect to the metal oxide in the intermediate layer.

* * * * *